US011139106B2

(12) United States Patent
Chou

(10) Patent No.: US 11,139,106 B2
(45) Date of Patent: Oct. 5, 2021

(54) TRANSFORMER AND TRANSFORMER BOBBIN THEREOF

(71) Applicant: INNOTRANS TECHNOLOGY CO., LTD., New Taipei (TW)

(72) Inventor: Tsung-Han Chou, Keelung (TW)

(73) Assignee: INNOTRANS TECHNOLOGY CO., LTD., New Taipei (TW)

( * ) Notice: Subject to any disclaimer, the term of this patent is extended or adjusted under 35 U.S.C. 154(b) by 286 days.

(21) Appl. No.: 16/548,254

(22) Filed: Aug. 22, 2019

(65) Prior Publication Data

US 2020/0090860 A1 Mar. 19, 2020

(30) Foreign Application Priority Data

Sep. 13, 2018 (TW) ..... 107132307

(51) Int. Cl.
*H01F 27/30* (2006.01)
*H01F 41/082* (2016.01)

(52) U.S. Cl.
CPC ..... *H01F 27/306* (2013.01); *H01F 41/082* (2016.01)

(58) Field of Classification Search
USPC ..... 336/198, 83, 199
See application file for complete search history.

(56) References Cited

U.S. PATENT DOCUMENTS

2009/0108976 A1* 4/2009 Nerone ..... H01F 27/326 336/192
2011/0043315 A1* 2/2011 Kobayashi ..... H01F 27/29 336/192
2013/0321114 A1* 12/2013 Lin ..... H01F 27/325 336/192

FOREIGN PATENT DOCUMENTS

CN 203760282 U 8/2014

* cited by examiner

*Primary Examiner* — Tszfung J Chan
*Assistant Examiner* — Kazi S Hossain
(74) *Attorney, Agent, or Firm* — Muncy, Geissler, Olds & Lowe, P.C.

(57) ABSTRACT

The invention provides a transformer and a transformer bobbin thereof. The transformer bobbin includes a winding part, a first wire outlet part and a second wire outlet part; the second wire outlet part is provided with an inclined guiding surface facing the winding part, a first partition plate arranged on the inclined guiding surface and a wire avoiding groove arranged on one side of the inclined guiding surface; the inclined guiding surface is divided into a first wire outlet area and a second wire outlet area, the wire avoiding groove is only arranged in the first wire outlet area, and the first partition plate is formed with a wire supporting notch. Therefore, it is not necessary to add an insulation sleeve to windings at the same wire outlet part to achieve winding isolation, whereby windings on the transformer is automatically wound by a machine.

9 Claims, 7 Drawing Sheets

TRANSFORMER AND TRANSFORMER BOBBIN THEREOF

FIELD OF THE INVENTION

The invention relates to a transformer and a transformer bobbin thereof, in particular to a transformer and a transformer bobbin thereof in which a plurality of windings at the same wire outlet part can be specifically isolated.

BACKGROUND OF THE INVENTION

At present, a transformer is not implemented only with a single winding any more but in multiple windings to meet the diversified requirements of the power, and the level of power conducted by each winding is different from that of another. Therefore, the transformer with multiple windings is sleeved with an isolation sleeve at the tail end of each winding during winding, so that interference among the windings is avoided.

However, this approach results in a failure to produce transformers automatically with machines.

In addition, patent No. CN 203760282 discloses a bobbin which can prevent winding from contacting each other during wire outgoing, but the bobbin is only suitable for the wire outgoing of a single winding and cannot be used for a transformer structure in which wires of multiple windings on the same side are led out.

SUMMARY OF THE INVENTION

The major object of the invention is to solve the problem that a conventional bobbin structure cannot perform isolation protection on multiple windings on the same side during wire outgoing.

To achieve the above object, the present invention provides a transformer, including a transformer bobbin, a core mounted on the transformer bobbin, a winding, at least one first sub-winding and a second sub-winding. The transformer bobbin includes a winding part, a first wire outlet part connected to one side of the winding part, and a second wire outlet part connected to the other side of the winding part where is not provided with the first wire outlet part. The second wire outlet part is provided with an inclined guiding surface facing the winding part, a first partition plate arranged on the inclined guiding surface and a wire avoiding groove arranged on one side of the inclined guiding surface 233 where is close to the winding part, and the second wire outlet part is divided into a first wire outlet area and a second wire outlet area by the first partition plate. The wire avoiding groove is only arranged in the first wire outlet area. The first partition plate is provided with a wire supporting notch. The winding is arranged on the winding part and is led out through the first wire outlet part, and the first sub-winding includes a first winding segment which is wound on the winding part and two first wire outlet segment respectively connected with the first winding segment and extended to the first wire outlet area through the wire avoiding groove. The second sub-winding includes a second winding segment which is wound on the winding part, and a second outlet segment connected with the second winding segment, and borne against the wire supporting notch as well as extended in the second wire outlet area.

In one embodiment, the transformer is provided with the first sub-windings, and the second wire outlet part is provided with a second partition plate which is positioned on the inclined guiding surface where is arranged in the first wire outlet area, the inclined guiding surface within the first wire outlet area is divided into a plurality of winding areas by the second partition plate, and each of the first sub-windings is arranged in one of the winding areas.

In one embodiment, the first wire outlet part and the second wire outlet part are respectively provided with a plurality of wire leading posts and a plurality of wire joining posts.

In one embodiment, the second wire outlet part is provided with a third partition plate which is arranged in the second wire outlet area and not positioned in the inclined guiding surface, and the second wire outlet area is divided into a plurality of outlet areas by the third partition plate.

In one embodiment, the second wire outlet part is provided with a plurality of retaining walls which are arranged on two sides of the inclined guiding surface.

In addition to the transformer mentioned above, the invention also provides a transformer bobbin, comprising a winding part, a first wire outlet part connected to one side of the winding part and a second wire outlet part connected to the other side the winding part where is not provided with the first wire outlet part. The second wire outlet part is provided with an inclined guiding surface facing the winding part, a first partition plate arranged on the inclined guiding surface and a wire avoiding groove arranged on one side of the inclined guiding surface where is close to the winding part. The first partition plate divides the inclined guiding surface into a first wire outlet area and a second wire outlet area. The wire avoiding groove is only arranged in the first wire outlet area. The first partition plate is formed with a wire supporting notch, and the second wire outlet part is provided with a plurality of retaining walls which are arranged on two sides of the inclined guiding surface.

In one embodiment, the second wire outlet part is provided with a second partition plate which is arranged in the first wire outlet area and positioned on the inclined guiding surface, and the inclined guiding surface within the first wire outlet area is divided into a plurality of winding areas by the second partition plate.

In one embodiment, the first wire outlet part and the second wire outlet part are respectively provided with a plurality of wire leading posts and a plurality of wire joining posts.

In one embodiment, the second wire outlet part is provided with a third partition plate which is arranged in the second wire outlet area and not positioned in the inclined guiding surface, and the second wire outlet area is divided into a plurality of outlet areas by the third partition plate.

In view of the implementation of the invention mentioned above, compared with the conventional technology, the invention comprises the following advantages: when a transformer is implemented to have a plurality of windings (namely the first sub-winding and the second sub-winding) at the same side, each sub-winding can be isolated without sleeving an isolation sleeve. Furthermore, the bobbin enables windings on the transformer to be wound automatically by a machine.

DETAILED DESCRIPTION OF THE PREFERRED EMBODIMENTS

Figure 1:
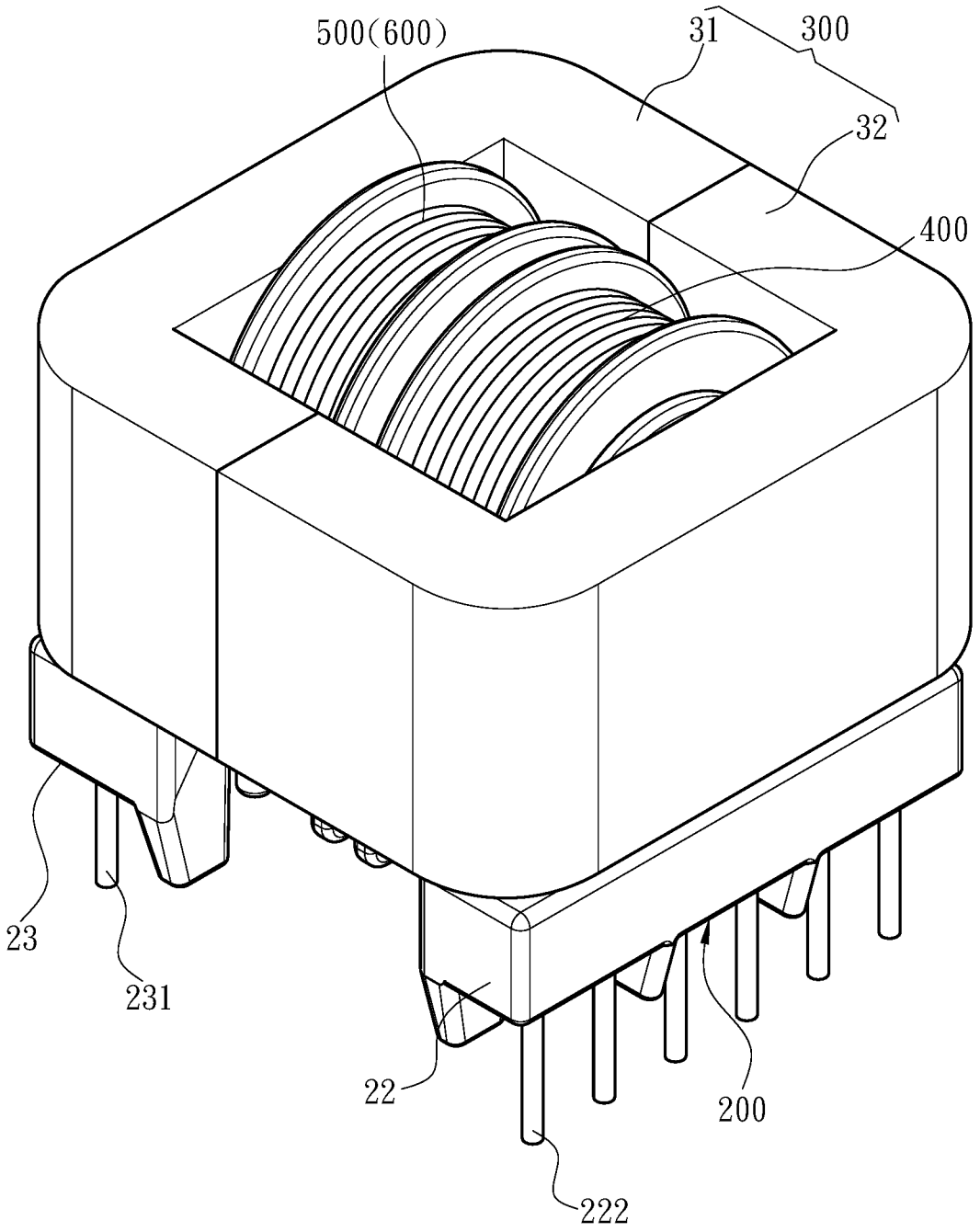
FIG. 1 is a schematic diagram showing the structure of a transformer according to an embodiment of the present invention.

The details and technical content of the present invention are now described with reference to the drawings:

With reference to FIGS. 1, 2, 3, 4, 5, 6 and 7, the present invention provides a transformer 100 and a transformer bobbin 200 thereof. First of all, the transformer bobbin 200 herein may change its basic model according to whether the transformer 100 is vertical or horizontal, that is, the model of the transformer bobbin 200 is not limited to horizontal as illustrated in the drawings. Further, the transformer bobbin 200 includes a winding part 21, a first wire outlet part 22 connected to one side of the winding part 21, and a second wire outlet part 23 connected to the other side of the winding part 21 where is not provided with the first wire outlet part 22. The winding part 21 is a cylindrical structure and is formed with a mounting space 211, wherein at least one dividing wall 212 is further arranged on the winding part 21 according to implementation requirements, so as to separate the windings through the dividing wall 212. Further, the first wire outlet part 22 and the second wire outlet part 23 may respectively comprise a plurality of wire leading posts 221, 231 and a plurality of wire joining posts 222, 232.

Figure 2:
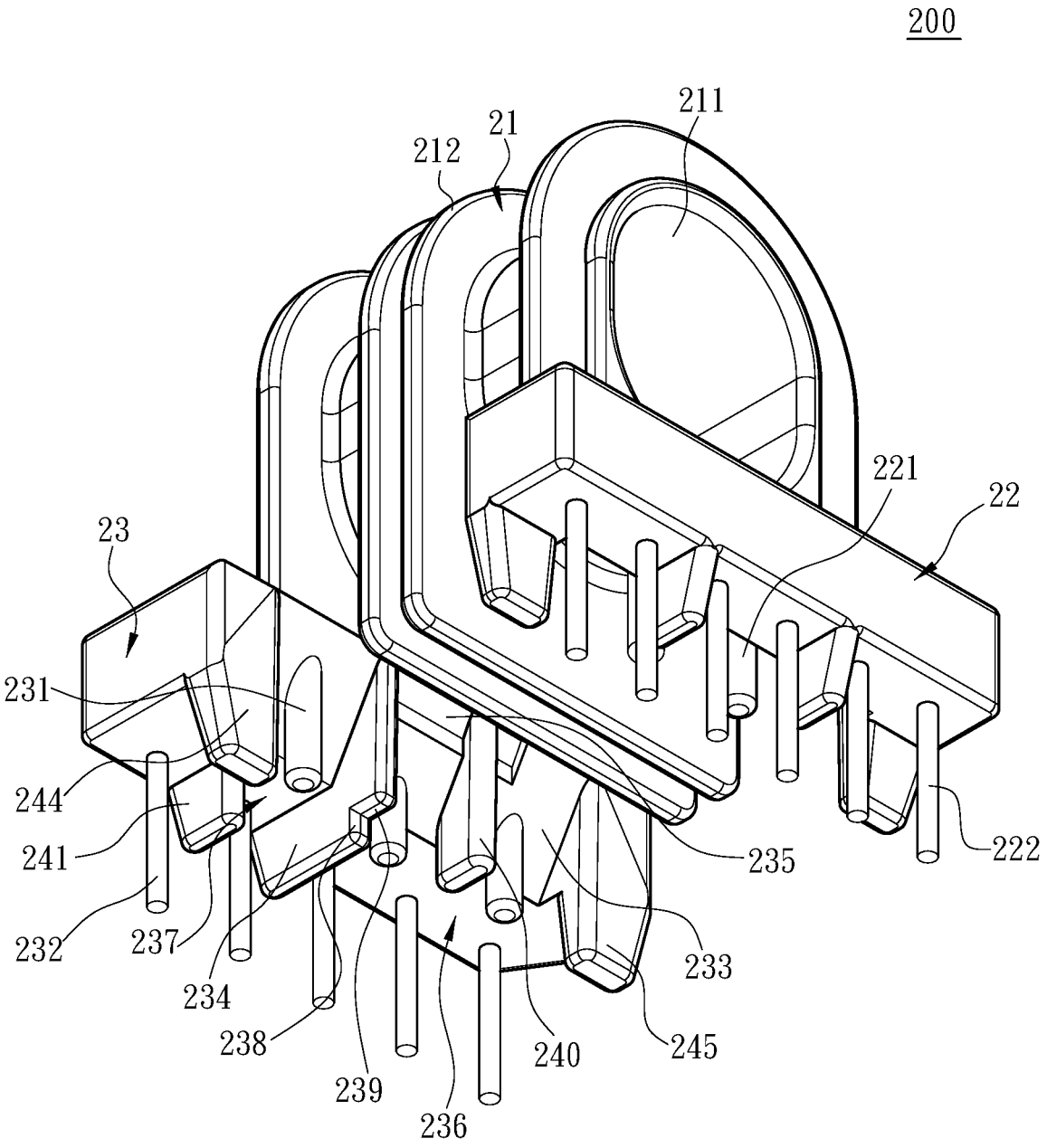
FIG. 2 is a schematic diagram showing the structure of a bobbin according to an embodiment of the present invention.
Figure 3:
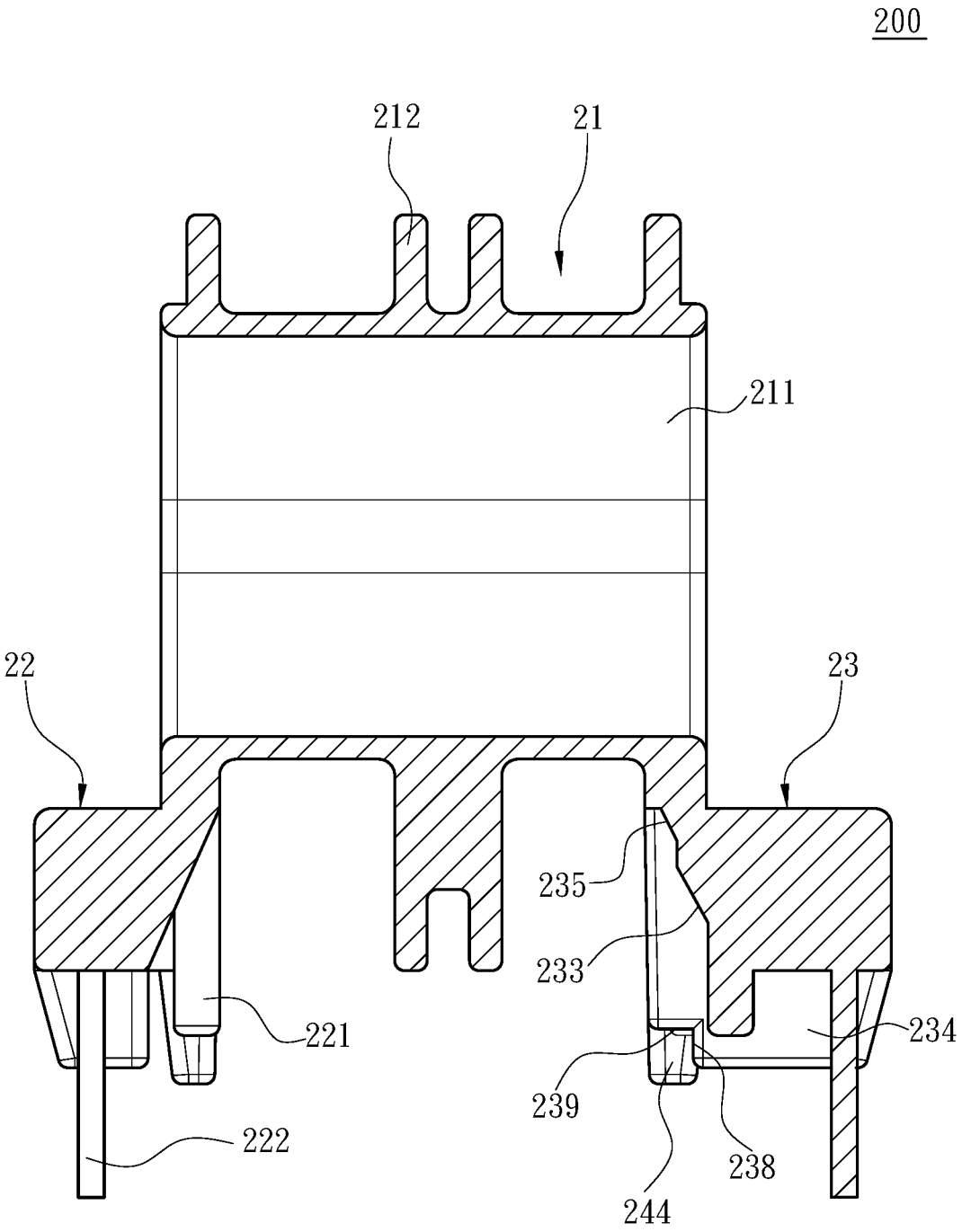
FIG. 3 is a schematic diagram (1) showing a cross-sectional structure of a bobbin according to an embodiment of the present invention.
Figure 4:
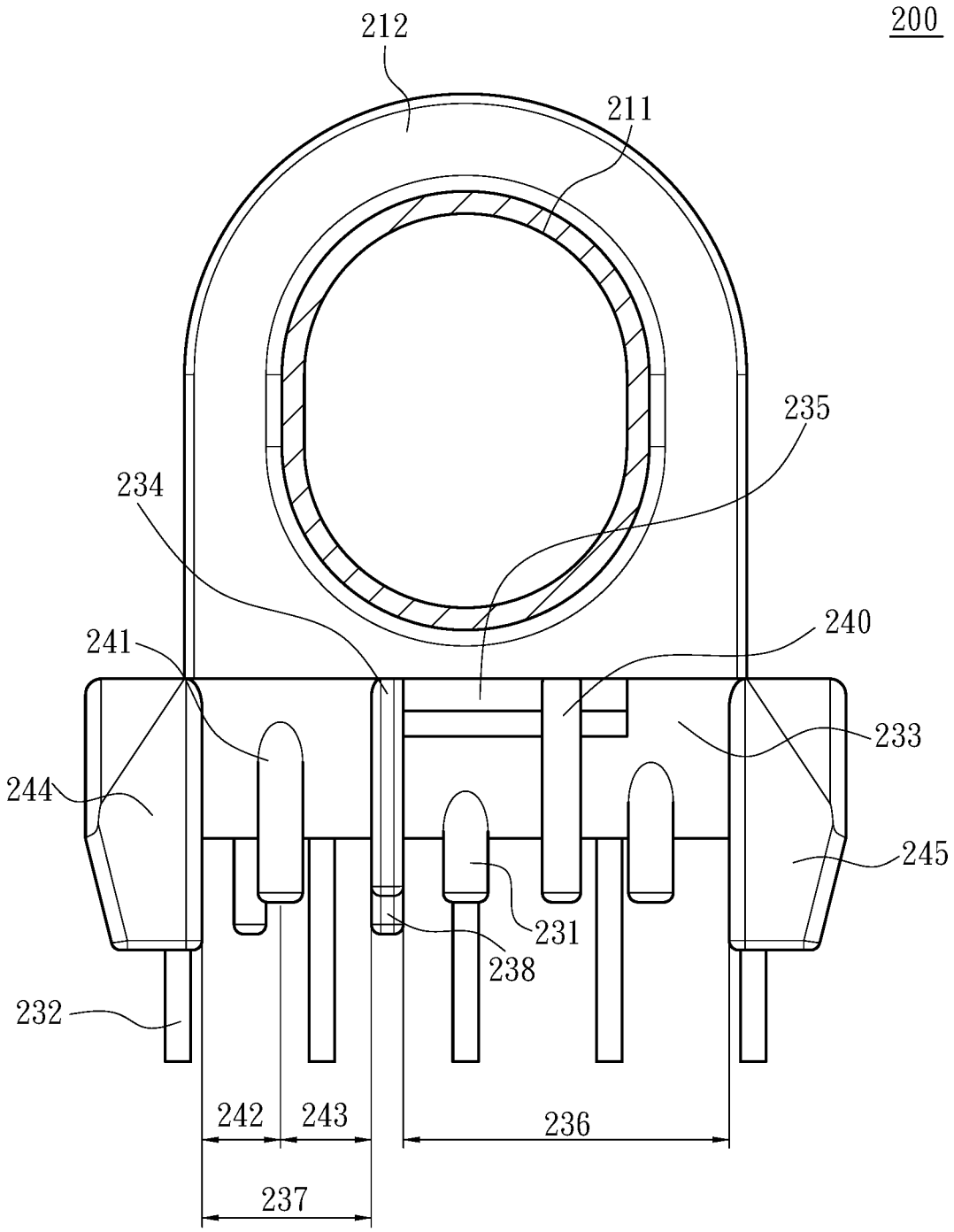
FIG. 4 is a schematic diagram (2) showing a sectional structure of a bobbin according to an embodiment of the present invention.

With reference to FIGS. 2, 3 and 4, the second wire outlet part 23 of the present invention further comprises an inclined guiding surface 233 facing the winding part 21, a first partition plate 234 provided on the inclined guiding surface 233, and a wire avoiding groove 235 provided on one side of the inclined guiding surface 233 where is close to the winding part 21. The inclined guiding surface 233 is divided into a first wire outlet area 236 and a second wire outlet area 237 by the first partition plate 234, and the wire avoiding groove 235 is a recess on the inclined guiding surface 233, and the wire avoiding groove 235 is only arranged in the first wire outlet area 236. Further, the first partition plate 234 is disposed transversely on the second wire outlet part 23, that is, two opposite ends of the first partition plate 234 are respectively disposed on two opposite sides of the second wire outlet part 23. In addition, a wire supporting notch 238 is formed in the first partition plate 234, and in one embodiment, the wire supporting notch 238 comprises a wire supporting surface 239 parallel to a surface of the second wire outlet part 23, wherein the surface is indicated by reference numeral 23 in FIG. 5.

Figure 5:
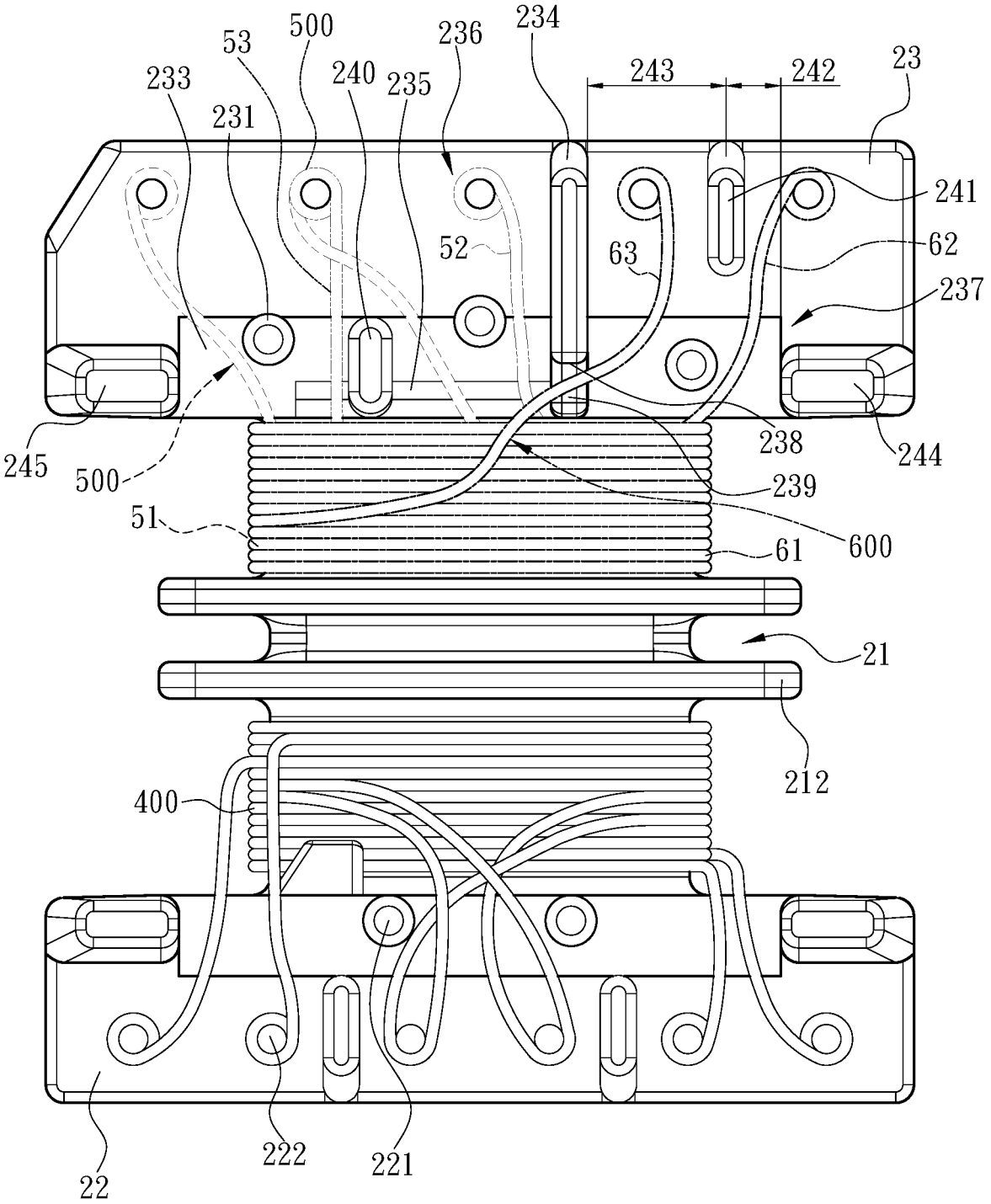
FIG. 5 is a schematic diagram showing the bottom view of a wound bobbin according to an embodiment of the present invention.
Figure 6:
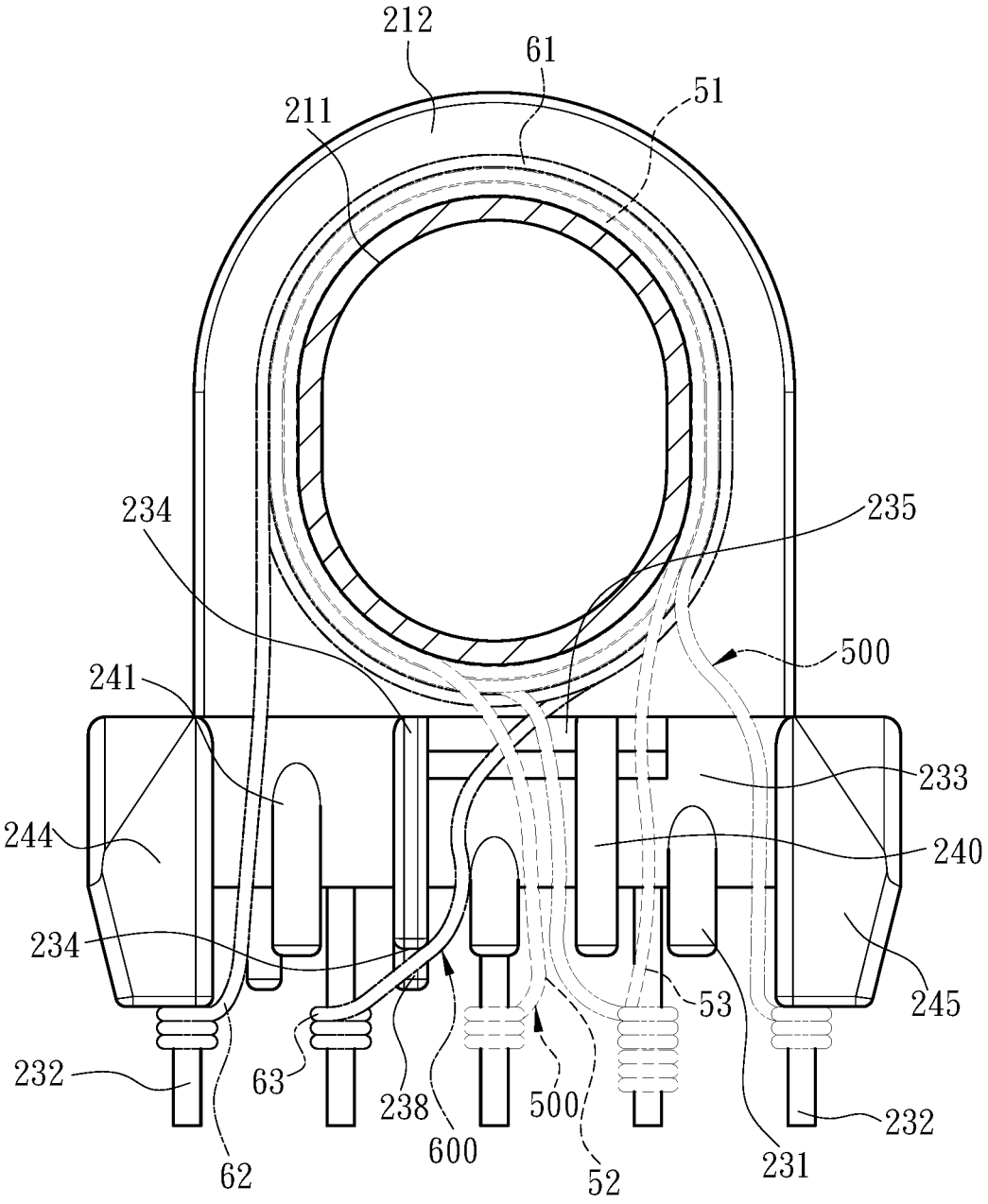
FIG. 6 is a schematic diagram (1) showing a cross-sectional structure of a wound bobbin according to an embodiment of the present invention.
Figure 7:
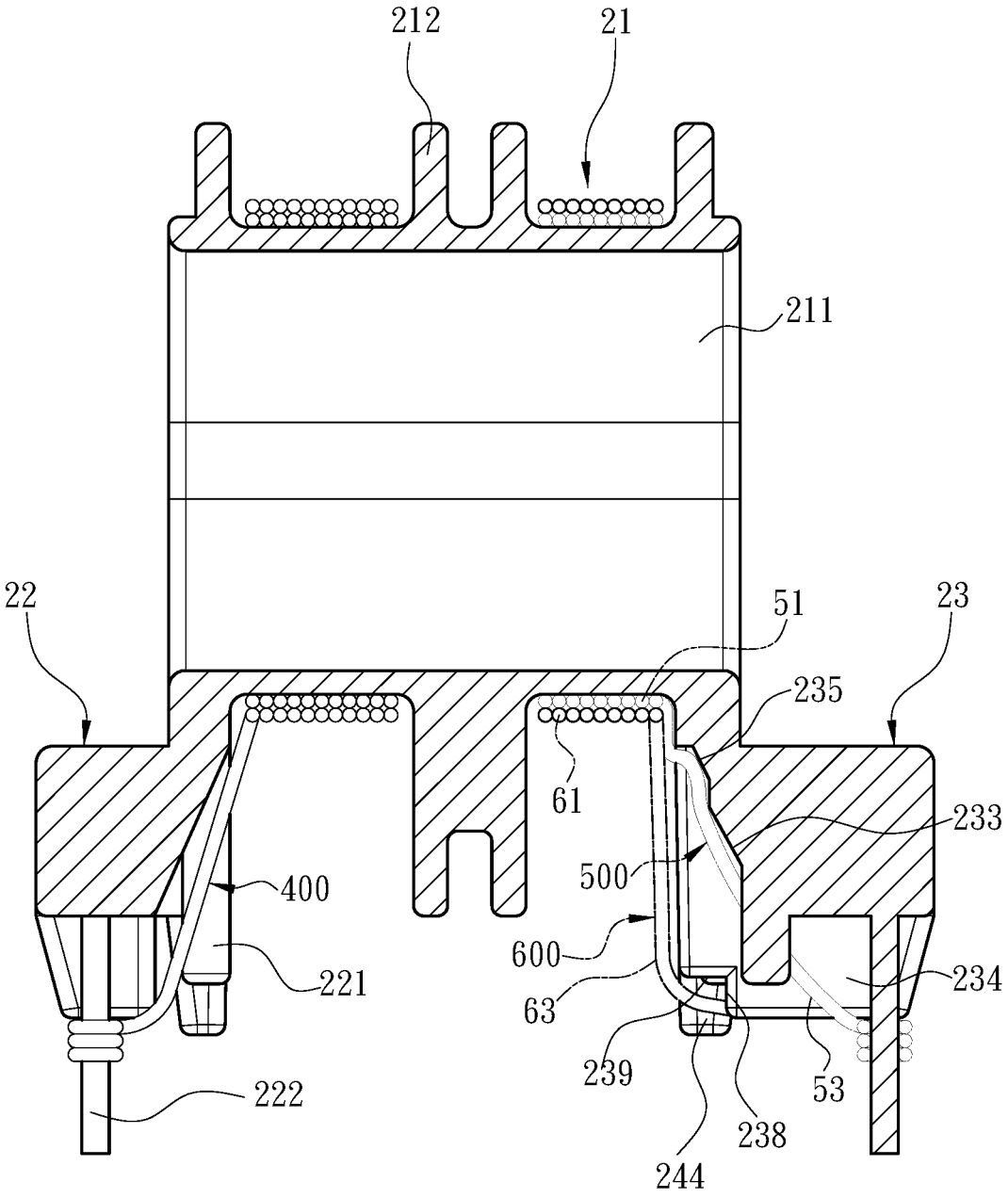
FIG. 7 is a schematic diagram (2) showing the sectional structure of a wound bobbin according to an embodiment of the present invention.

With reference again to FIG. 1, the transformer 100 of the present invention includes, in addition to the transformer bobbin 200, a core 300, a winding 400, at least one first sub-winding 500 and a second sub-winding 600. A part of the core 300 is arranged in the mounting space 211, the rest part of the core 300 is arranged around the transformer bobbin 200, the core 300 is composed of two sub-iron cores 31, 32, and the two sub-iron cores 31, 32 can be in an EE model or other models according to implementation. In another aspect, the winding 400 is formed by winding a sequence of metal wire, and the winding 400 is arranged on the winding part 21 where wire outgoing of the winding 400 passes through the first wire outlet part 22, that is, the ends of the winding 400 are respectively connected to one of the wire joining posts 222 of the first wire outlet part 22. Furthermore, the winding 400 is not limited to a single winding implementation, but may be implemented as a plurality of windings, as shown in FIG. 5.

Further, a primary side of the transformer 100 of the present invention is composed of the first sub-winding 500 and the second sub-winding 600. Further, the first sub-winding 500 may be implemented as a plurality of windings as desired. With reference again to FIG. 5, the first sub-winding 500 is also formed by winding a sequence of metal wire. Further, the first sub-winding 500 includes a first winding segment 51 which is wound on the winding part 21, and two first outlet segments 52, 53 respectively connected to the first winding segment 51 and extended to the first wire outlet area 236 through the wire avoiding groove 235. More specifically, at the beginning of winding the first sub-winding 500, an end of a wire enters from the first wire outlet area 236, passes through the wire avoiding groove 235 and extends toward the winding part 21, and what the aforementioned wire segment forms herein can be referred to as one of the first outlet segment 52. Next, the wire is wound around the winding part 21 according to what a set number of turns forms herein can be referred to as the first winding segment 51, after which the wire extends to the first wire outlet area 236 through the wire avoiding groove 35 to form another one of the first outlet segment 53.

In another aspect, the second sub-winding 600 is also formed by winding a sequence of metal wire. The second sub-winding 600 includes a second winding segment 61 which is wound on the winding part 21 and two second outlet segments 62, 63, and one of the two second outlet segments 62, 63 (which is corresponding to reference numeral 62) is connected to the second winding segment 61 and extended in the second wire outlet area 237, the other one of the two second outlet segments 62, 63 (which is corresponding to reference numeral 63) is connected to the second winding segment 61 and borne against the wire supporting notch 238 as well as extended in the second wire outlet area 237. Specifically, the winding of the second sub-winding 600 may be performed after the winding of the first sub-winding 500 is completed, and before the winding of the second sub-winding 600, an insulating tape is wound on a part that is corresponding to the first winding segment 51. At the beginning of winding the second sub-winding 600, the end of the wire enters from the second wire outlet area 237, and the wire is confined by the first partition plate 234, so as to avoid entering the first wire outlet area 236, the aforementioned wire segment is referred to as one of the two second outlet segment 62 herein. Next, the wire is wound around the winding part 21 according to the set number of turns to form the second winding segment 61 referred to herein, after which the wire extends to the second wire outlet area 237 through the wire supporting notch 238 to form the other one of the two second outlet segment 63 as aforementioned.

As can be seen from the above, the first sub-winding 500 does not extend to the second wire outlet area 237, so as to isolate from the second sub-winding 600 during winding. Furthermore, the two first outlet segments 52, 53 of the first sub-winding 500 pass through the wire avoiding groove 235, in order to avoid the second outlet segment 63 of the second sub-winding 600 whereby it is not necessary to additionally provide a protective sleeve on the first sub-winding 500 or the second sub-winding 600, the winding of the transformer 100 can be concretely mechanized, and further relived from the process of arranging the protective sleeve and the corresponding costs.

With reference to FIG. 4, in one embodiment, the first sub-winding 500 is implemented as a plurality windings due to the transformer bobbin 200, the second wire outlet part 23 of the transformer bobbin 200 comprises a second partition plate 240 positioned on the inclined guiding surface 233 where is arranged in the first wire outlet area 236. In addition, in one embodiment, the second wire outlet part 23 of the transformer bobbin 200 may further comprise a third partition plate 241 which is arranged in the second wire outlet area 237 and not positioned in the inclined guiding surface 233, and the second wire outlet area 237 is divided into a plurality of outlet areas 242, 243 by the third partition plate 241. Therefore, the second outlet segments 62, 63 of the second winding segment 61 are separated.

With reference to FIG. 2, in one embodiment, the second wire outlet part 23 comprises two retaining walls 244, 245 respectively disposed on two sides of the inclined guiding surface 233, the two retaining walls 244, 245 allow the wire to be specifically confined within the winding part 21 of the transformer bobbin 200 when winding the first winding segment 51 or the second winding segment 61. In addition, the first wire outlet part 22 may be configured as shown in the drawings.

What is claimed is:

1. A transformer, comprising:

a transformer bobbin, including a winding part, a first wire outlet part connected to one side of the winding part, and a second wire outlet part connected to the other side of the winding part where is not provided with the first wire outlet part, the second wire outlet part provided with an inclined guiding surface facing the winding part, a first partition plate arranged on the inclined guiding surface and a wire avoiding groove arranged on one side of the inclined guiding surface where is close to the winding part, the second wire outlet part divided into a first wire outlet area and a second wire outlet area by the first partition plate, the wire avoiding groove only arranged in the first wire outlet area, and the first partition plate provided with a wire supporting notch;

a core, mounted on the transformer bobbin;

a winding, arranged on the winding part and led out through the first wire outlet part;

at least one first winding, including a first winding segment which is wound on the winding part, and a first outlet segment connected with the first winding segment and extended to the first wire outlet area through the wire avoiding groove; and a second sub-winding, including a second winding segment which is wound on the winding part, and two second outlet segments respectively connected with the second winding segment, and borne against the wire supporting notch and extended in the second wire outlet area.

2. The transformer according to claim 1, wherein the transformer is provided with the first sub-windings, the second wire outlet part is provided with a second partition plate positioned on the inclined guiding surface where is arranged in the first wire outlet area, the inclined guiding surface within the first wire outlet area is divided into a plurality of winding areas by the second partition plate, and each of the first sub-windings is arranged in one of the plurality of winding areas.

3. The transformer according to claim 1, wherein the first wire outlet part and the second wire outlet part are respectively provided with a plurality of wire leading posts and a plurality of wire joining posts.

4. The transformer according to claim 1, wherein the second wire outlet part is provided with a third partition plate which is arranged in the second wire outlet area and not positioned in the inclined guiding surface, and the second wire outlet area is divided into a plurality of outlet areas by the third partition plate.

5. The transformer according to claim 1, wherein the second wire outlet part is provided with a plurality of retaining walls which are arranged on two sides of the inclined guiding surface.

6. A transformer bobbin, comprising:

a winding part;

a first wire outlet part, connected to one side of the winding part;

a second wire outlet part, connected to the other side of the winding part where is not provided with the first wire outlet part, the second wire outlet part is provided with an inclined guiding surface facing the winding part, a first partition plate arranged on the inclined guiding surface and a wire avoiding groove arranged on one side of the inclined guiding surface, where is close to the winding part; the inclined guiding surface divided into a first wire outlet area and a second wire outlet area by the first partition plate, the wire avoiding groove only arranged in the first wire outlet area, and the first partition plate formed with a wire supporting notch, the second wire outlet part provided with a plurality of retaining walls which are arranged on two sides of the inclined guiding surface.

7. The transformer bobbin according to claim 6, wherein the second wire outlet part is provided with a second partition plate which is arranged in the first wire outlet area and positioned on the inclined guiding surface, the inclined guiding surface within the first wire outlet area is divided into a plurality of winding areas by the second partition plate.

8. The transformer bobbin according to claim 6, wherein the first wire outlet part and the second wire outlet part are respectively provided with a plurality of wire leading posts and a plurality of wire joining posts.

9. The transformer bobbin according to claim 6, wherein the second wire outlet part is provided with a third partition plate which is arranged in the second wire outlet area and not positioned on the inclined guiding surface, and the second wire outlet area is divided into a plurality of outlet areas by the third partition plate.

* * * * *